United States Patent [19]

Borda

[11] Patent Number: 4,574,484

[45] Date of Patent: Mar. 11, 1986

[54] PATTERNGRAPH APPARATUS

[76] Inventor: Edwardo R. Borda, 2701 Common St., Lake Charles, La. 70601

[21] Appl. No.: 674,498

[22] Filed: Nov. 23, 1984

[51] Int. Cl.[4] ..... B43L 11/00

[52] U.S. Cl. ..... 33/27.11

[58] Field of Search ..... 33/27 R, 27 G, 27 K, 33/27 L

[56] References Cited

U.S. PATENT DOCUMENTS

| | | | |
|---|---|---|---|
| 859,366 | 7/1907 | Clark | 33/27 L |
| 894,205 | 7/1908 | Horsman, Jr. | 33/27 L |
| 1,307,958 | 6/1919 | Chaney | 33/27 L |
| 1,980,917 | 11/1934 | Grupp | 33/27 L |

FOREIGN PATENT DOCUMENTS

| | | | |
|---|---|---|---|
| 1577860 | 4/1969 | Fed. Rep. of Germany | 33/27 L |
| 913013 | 8/1946 | France | 33/27 L |
| 1081166 | 12/1954 | France | 33/27 L |
| 1105994 | 12/1955 | France | 33/27 L |
| 1457978 | 9/1966 | France | 33/27 L |

*Primary Examiner*—Richard R. Stearns

[57] ABSTRACT

The apparatus serves to draw various geometric patterns on circular sheets of paper. Primarily, it consists of a base having a hand operated drive wheel that rotates a turntable, to which a piece of circular paper has been attached by pins sticking up from its surface. It also includes an adjustable pen holder support, which is fastened to a guide rod which is removably received, at one end, in any one of a number of grooves in a weave rack rod fastened to the base, and the other end of the guide rod is removably received in any one of several openings in a French curve arm pivotally adjustable on the drive wheel.

1 Claim, 2 Drawing Figures

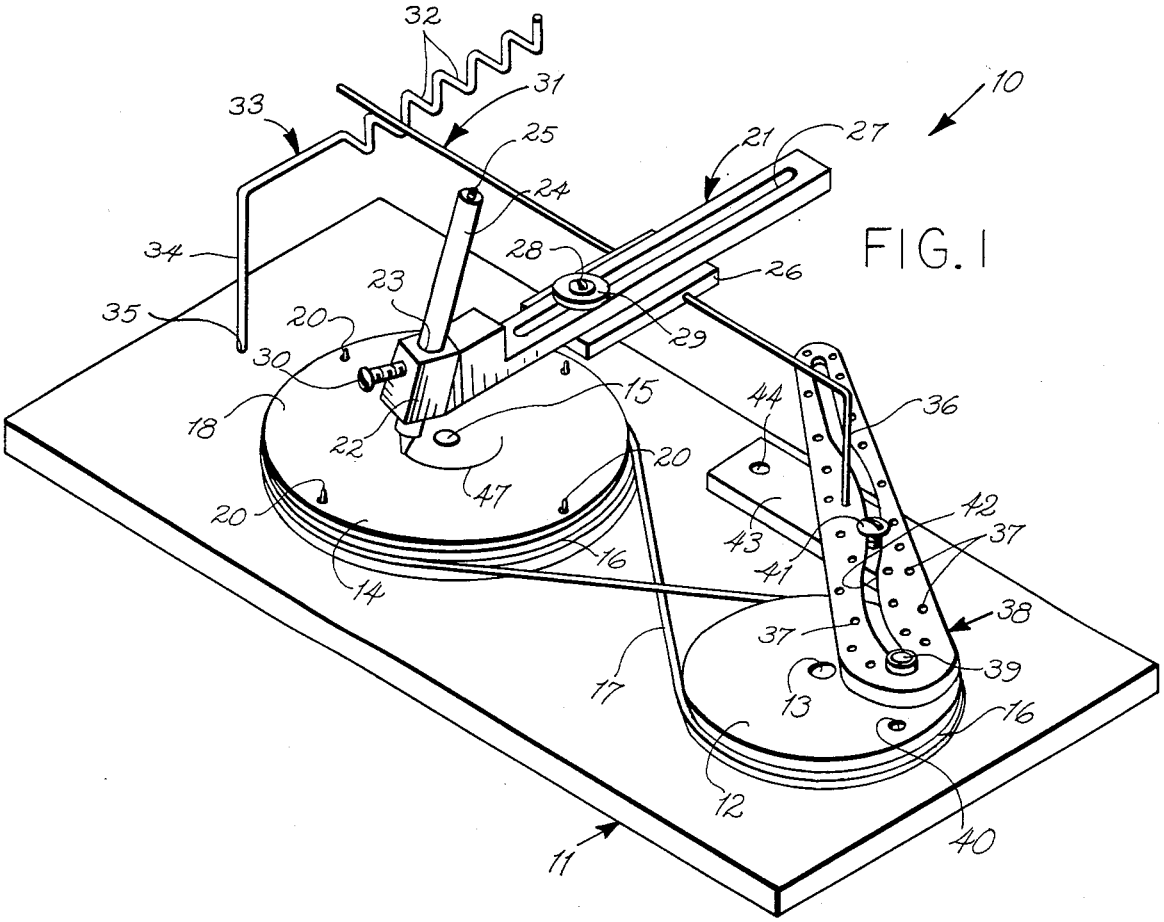
FIG. 1
FIG. 2
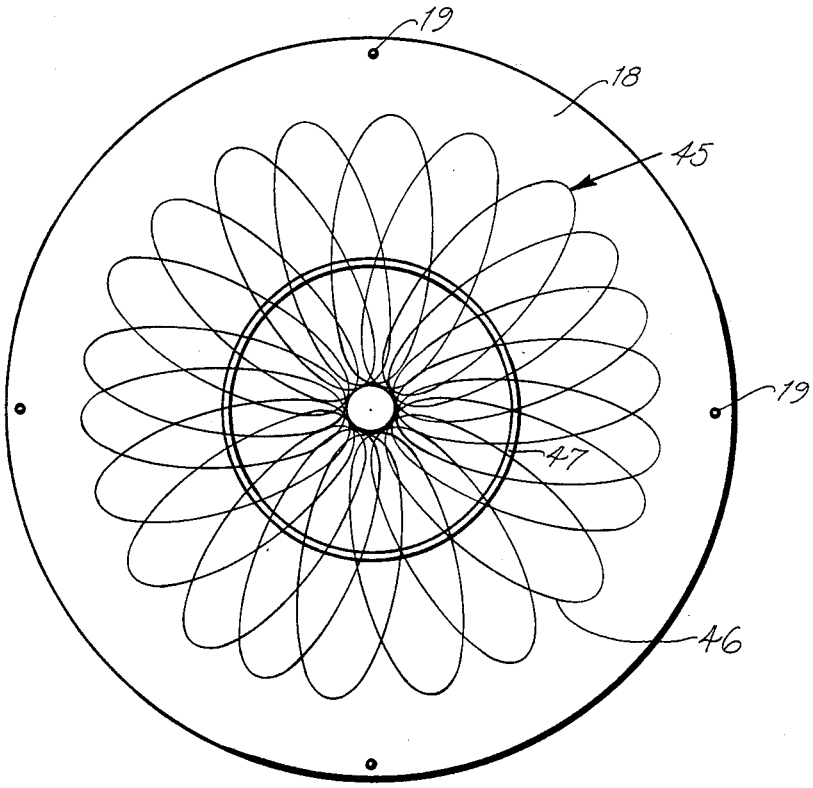

PATTERNGRAPH APPARATUS

This invention relates to drawing instruments, and more particularly, to a patterngraph apparatus.

The principal object of this invention is to provide a patterngraph apparatus, which will be unique in design for drawing an infinite number of complicated and symmetrical figures.

Another object of this invention is to provide a patterngraph apparatus, which will be of such design, as to draw such figures at the move of one of its components.

Another object of this invention is to provide a patterngraph, which will be of such design, as to be enjoyed by the whole family, and it may be used by those aged five and up.

A further object of this invention is to provide a patterngraph apparatus, which will be capable of producing more than one hundred figures.

Other objects are to provide a patterngraph apparatus, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, and

FIG. 2 is a top plan view of one of the figures that may be drawn by the invention.

Accordingly, an apparatus 10 is shown to include a rectangular base 11, having a drive wheel 12 rotatable on a center pin 13, which is suitably secured within an opening in the top of base 11, which is not shown. A turntable 14 is provided, and is rotatable on a center pin 15 in the top of base 11, and drive wheel 12 and turntable 14 include an annular groove 16 in their outer peripheries, which receives a drive belt 17 for 12 and 14 to rotate simultaneously. A circular sheet of paper 18, for use on apparatus 10, includes a plurality of equally and radially spaced openings 18 therethrough, for receiving similarly arranged and projecting pins 20, which are suitably secured within the top of turntable 14, for rendering paper 18 stationary thereon.

A pen holder support member 21 is provided, and has a weight 22 suitably fixedly secured to one end, for holding member 21 downward at its scribing end, and an opening 23 through the top of weight 21 includes a pen holder sleeve 24 therein, which removably receives a pen 25 for drawing on paper 18. A rod guide plate 26 is received beneath support member 21, and an elongated cut-out opening 27, through member 21, receives a screw fastener 28, having a washer 29 thereon. Fastener 28 is threaded into an opening through rod guide plate 26, and provides adjustment means for the travel of pen holder support member 21. A set screw 30 is threaded into weight 22, for securing pen holder 24 at any desired elevation within support member 21, and an "L"-shaped guide rod 31 is provided, and one end thereof is removably received within any one of a plurality of adjacent grooves 32 formed within a weave rack 33, which has its right angle end 34 suitably fixedly secured within an opening 35 in the top of base 11. The right angle end 36 of guide rod 31 is removably received within any one of a plurality of random spaced openings 37 in the top of French curve arm 38, which is pivotally received on a pin 39, which is removably received within one of two openings 40 through drive wheel 12. A set screw 41 is received within an irregularly curved groove 42 through arm 38, and is threaded into an opening through plate 43 (which is not shown), and plate 43 is secured to the top of base 11 by means of suitable fasteners 44, one of which is shown. The screw 41 provides adjustment means for the different kinds of patterns to be drawn by apparatus 10, as illustrated by pattern 45 having the geometric drawn form, consisting of lines 46 and the circles 47.

In use, the base 11 is positioned so as to have the drive wheel 12 to the right of the user. The weave rack rod 33 is then moved to an approximately ninety degree angle with the edge of the base 11. The user then places several of the round papers 18 on the turntable 14, and presses them downward upon the pins 20, which will hold paper 18 in place. The guide rod 31 is then placed with its long end within any one of the grooves 32 of rack 33, and the end 36 of rod 31 is then placed into any one of the openings 37 in French curve arm 38. The pen 25 is then placed to about the center of the paper 18, and the user rotates the drive wheel 12, which will, in turn, rotate the turntable 14, thus causing the pattern 45 or other similar type to be drawn.

A change of pattern 45 can be accomplished by moving the pen holder 24 up or down, as desired, and in evey position the figure will be different. By moving the pen 25 from right to left, the apparatus 10 will change lines, and by moving the guide rod 31 to different openings 37 in the French curve arm 38, the results is another figure or change of positions, and finally, moving the guide rod 31 to any other groove 32 of rack 33 will produce different figures, still of geometric form.

While various changes may be made in the detail construction, it is understood that such changes will be within the spirit and scope of the present invention, as is defined by the appended claims.

What I claim is:

1. A patterngraph apparatus, comprising, in combination, a base, a first pin mounted upon said base, a drive wheel rotatably supported at its center on said pin, a turntable rotatably supported at its center, upon a second pin mounted upon said base, an annular groove around said drive wheel and around said turntable, an endless belt in both said grooves transmitting rotational movement therebetween, a plurality of upwardly projecting pins upon said turntable, a sheet of paper having a plurality of openings receiving said projecting pins for removable securement of said paper upon said turntable; an elongated arm having a longitudinally extending, irregularly curved slot being pivotally rocked about a screw stationarily mounted upon said base, said screw being received through said arm slot, an eccentrically mounted pin upon said drive wheel being also received through said arm slot, an "L"-shaped guide rod, a plurality of holes along said arm selectively receiving a bent-down end of said guide rod; a guide rod rest pivotally mounted upon said base, a row of notches upon said guide rod rest selectively supporting an opposite end of said guide rod, a guide rod plate supported on said guide rod, a pen-holding member extending transversely to said guide rod, being adjustably securable to said guide rod plate, and a pen upon an end of said pen-holding member for drawing a pattern upon said sheet of paper, when said drive wheel is rotated.

* * * * *